US008981650B2

(12) United States Patent
Burayez et al.

(10) Patent No.: US 8,981,650 B2
(45) Date of Patent: Mar. 17, 2015

(54) LIGHTING DEVICE CONTROLLER PROGRAMMING

(75) Inventors: Ammar Burayez, Silverado, CA (US); Ivan Ivanov, Fountain Valley, CA (US); William A. Hunt, Foothill Ranch, CA (US); John W. Matthews, Newport Beach, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 13/570,943

(22) Filed: Aug. 9, 2012

(65) Prior Publication Data

US 2013/0043795 A1 Feb. 21, 2013

Related U.S. Application Data

(60) Provisional application No. 61/524,730, filed on Aug. 17, 2011.

(51) Int. Cl.
*H05B 37/02* (2006.01)
*H05B 33/08* (2006.01)

(52) U.S. Cl.
CPC ..... *H05B 37/0272* (2013.01); *H05B 33/0842* (2013.01)
USPC ..... 315/150; 315/151; 362/249.05

(58) Field of Classification Search
USPC ..... 315/150, 151, 154, 159, 313, 320; 362/202, 249.05
See application file for complete search history.

(56) References Cited

U.S. PATENT DOCUMENTS

| | | | | |
|---|---|---|---|---|
| 6,169,377 | B1 | 1/2001 | Bryde et al. | |
| 7,220,016 | B2 | 5/2007 | Matthews et al. | |
| 7,293,893 | B2 | 11/2007 | Kim | |
| 7,722,209 | B2 | 5/2010 | Matthews et al. | |
| 7,788,833 | B2 * | 9/2010 | Hauck et al. | 40/442 |
| 8,182,109 | B2 | 5/2012 | Matthews et al. | |
| 8,456,092 | B2 * | 6/2013 | Knapp | 315/152 |

FOREIGN PATENT DOCUMENTS

| | | |
|---|---|---|
| WO | WO 2008/065607 | 6/2008 |
| WO | WO 2009/060373 | 5/2009 |

OTHER PUBLICATIONS

Baddi et al. "Use LEDs as photodiodes", Nov. 18, 2010, p. 1.*

* cited by examiner

*Primary Examiner* — Daniel D Chang
(74) *Attorney, Agent, or Firm* — Haynes and Boone, LLP

(57) ABSTRACT

Various techniques are provided for programming lighting devices. In one example, a lighting device includes a light emitting diode (LED). The lighting device also includes a microcontroller configured to receive a programming signal generated by the LED in response to illumination of the LED with an externally-supplied light signal modulated with the programming signal.

20 Claims, 5 Drawing Sheets

LIGHTING DEVICE CONTROLLER PROGRAMMING

CROSS-REFERENCE TO RELATED APPLICATIONS

This application claims the benefit of U.S. Provisional Patent Application No. 61/524,730 filed Aug. 17, 2011 which is hereby incorporated by reference in its entirety.

BACKGROUND

1. Technical Field

This application relates to lighting devices and, more particularly, to the programming of a controller within a lighting device.

2. Related Art

Flashlights and other types of lighting devices (e.g., headlamps or others) using light emitting diodes (LEDs) are rapidly replacing conventional sources of illumination such as incandescent bulbs. LEDs are significantly more efficient than incandescent bulbs and thus offer greater illumination power and battery life. Moreover, LEDs are typically less fragile and are thus more robust than incandescent bulbs. The incorporation of LEDs has not been the only major recent technological advance in the lighting device arts. For example, LED-based lighting devices may now include a controller such as a microcontroller or a microprocessor.

The addition of a controller enables the lighting device to be programmed to regulate the power supplied to the LED as a function of a switch actuation from the user as well as the battery condition. Moreover, the microcontroller provides various modes of operation. For example, a lighting device may include an SOS mode, a power-saving mode, or other modes. Indeed, the nature of the operating modes is only limited by the programmer's ingenuity. Although the addition of a microcontroller thus enhances lighting device's operation, a user typically has no means of re-programming the microcontroller to customize the lighting device to their particular needs. In that regard, the addition of a suitable input programming port such as a universal serial bus (USB) port to provide programming access to the microcontroller would add additional expense.

Accordingly, there is a need in the art for providing improved lighting device programming access.

SUMMARY

In accordance with a first embodiment, a lighting device is provided that includes an LED; and a controller configured to receive a programming signal generated by the LED in response to illumination of the LED with an externally-supplied light signal modulated with the programming signal.

In accordance with a second embodiment, a method is provided that includes: illuminating a lighting device's LED with a light signal modulated with a programming signal, wherein the LED generates a current responsive to the illumination; and programming a controller within the lighting device according to the programming signal received from the illuminated LED.

In accordance with a third embodiment, a lighting device programming tool is provided that includes a housing adapted to mate with a lighting device bezel; at least one LED contained within the housing; and a driving circuit operable to drive the LED according to a programming signal supplied by a programming host.

The scope of the invention is defined by the claims, which are incorporated into this section by reference. A more complete understanding of embodiments of the present disclosure will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present disclosure and their advantages are best understood by referring to the detailed description that follows. It should be appreciated that like reference numerals are used to identify like elements illustrated in one or more of the figures.

DETAILED DESCRIPTION

A lighting device programming technique is disclosed herein that obviates the need to reconfigure a lighting device with a programming input port such as a USB port. The lighting device is configured to respond to programming through its LED(s) rather than through an external programming input port. Although various embodiments will be described and illustrated with regard to various flashlights, the techniques so described and illustrated may also be applied to other embodiments and other types of lighting devices such as, for example, headlamps, portable lighting devices, and other lighting devices.

Figure 1:
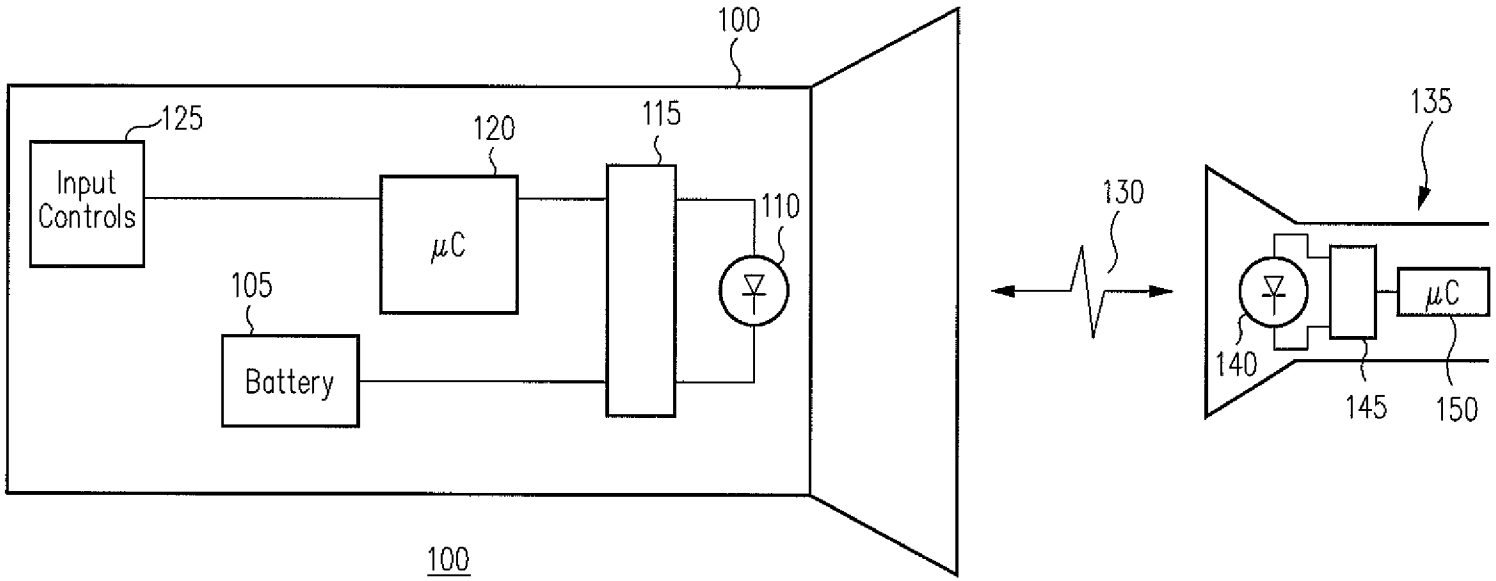
FIG. 1 is a longitudinal cross sectional view of a flashlight and an external programming tool in accordance with an embodiment of the disclosure.

Turning now to the drawings, FIG. 1 illustrates an example flashlight 100. A battery 105 powers at least one LED 110 through a driver circuit 115 as controlled by a microcontroller or processor 120. Depending upon the applied programming, microcontroller 120 controls switches and signal conditioning circuitry within driver circuit 115 to, for example, control the amount of power supplied to LED 110 responsive to a user's power mode selection through input controls 125.

Flashlight 100 may be configured into a normal mode of operation and also a programming mode of operation through appropriate actuation of input controls 125. In the programming mode, LED 110 responds to an externally-supplied light signal 130 (also referred to as light 130) supplied by an external programming tool 135. Light 130 may be implemented in accordance with any desired non-visible and/or visible wavelengths as may be desired in various applications.

For example, in one embodiment, light 130 may be infrared light. In another embodiment, light 130 may be visible light.

Programming tool 135 includes at least one LED 140 powered through a driver circuit 145 as controlled by a programming microcontroller or processor 150. LED 140 is thus driven according to a programming signal generated so that light 130 is modulated by the desired programming signal. For example, the programming signal may simply be an on-off keying of light 130 although any suitable modulation scheme may be used to modulate light 130. In response to the illumination by light 130, LED 110 will generate a current or voltage sensed by microcontroller 120. The generated current or voltage is demodulated and digitized in driver circuit 115 to recover a digital programming signal that was originally applied by programming tool 135 to modulate light 130. In the programming mode, microcontroller 120 responds to the programming signal so as to be programmed into the desired behavior.

A user could thus use programming tool 135 to program microcontroller 120 to effect a desired mode of operation. For example, an SOS light pattern could thus be programmed into flashlight 100 using programming tool 135. Alternatively, microcontroller 120 could be programmed so that a user could select different LED sources and/or power levels through actuations of input controls 125. Advantageously, flashlight 100 thus needs no external programming port, which dramatically lowers costs yet enables programming of microcontroller 120.

Figure 2:
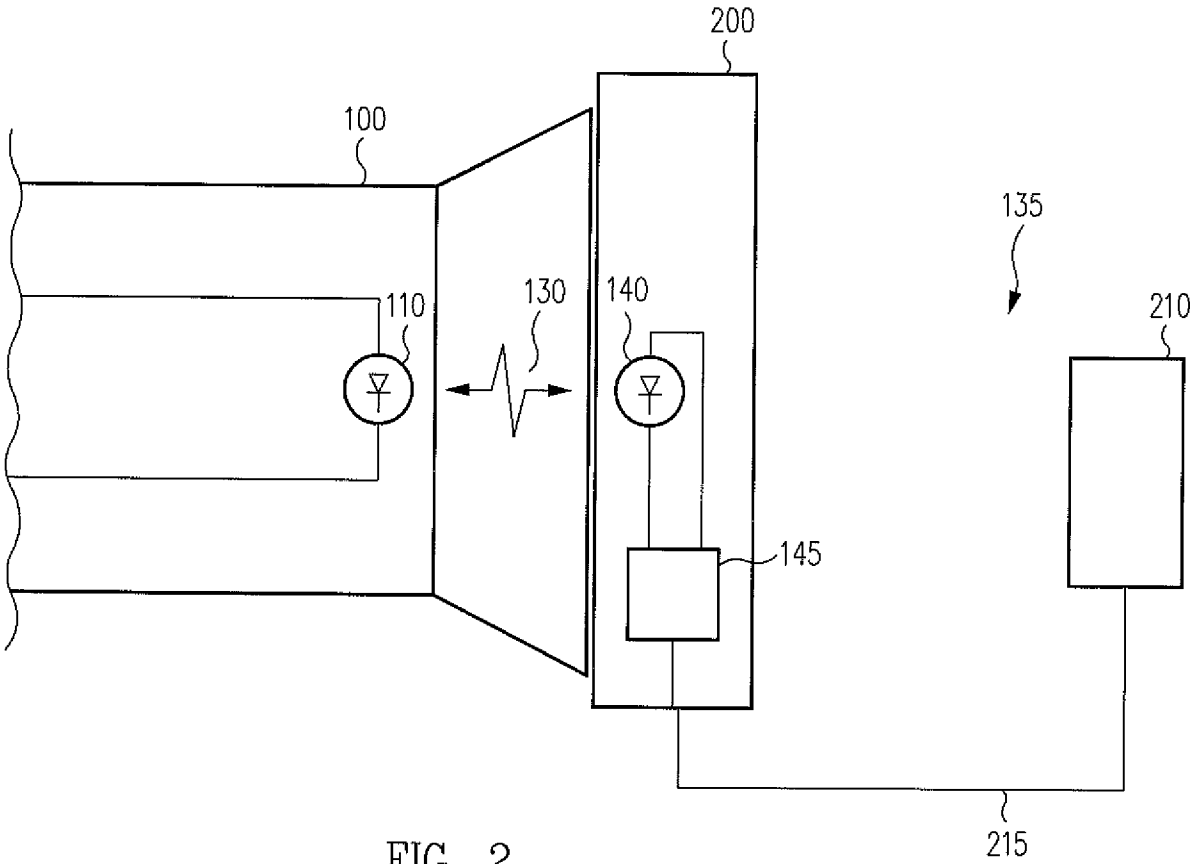
FIG. 2 illustrates an alternative embodiment for the programming tool of FIG. 1.

Processor 150 need not be included within programming tool 135. For example, as seen in FIG. 2, a programming dongle 200 includes LED 140 and LED driver circuit 145. A power source for programming tool 135 is not shown for illustration clarity in both FIGS. 1 and 2. Dongle 200 is designed to be placed directly against the bezel of flashlight 100 so as to better illuminate LED 110. A programming host such as a personal computer (PC) 210 delivers a programming signal over a bus such as a USB cable 215 so that LED 140 is driven accordingly to program flashlight 100 as desired. Note that LED 140 may also respond to illumination from flashlight 100 so that an error-free reception of the programming signal may be confirmed (e.g., to indicate successful or unsuccessful programming). Thus, light 130 is shown not only propagating from programming tool 135 but also being received by programming tool 135. Driver circuit 145 may include demodulating and analog-to-digital conversion circuitry to retrieve a digital confirmation signal from flashlight 100 so that host PC 210 is assured that the desired programming signal has been received correctly. In various embodiments, light 130 propagating from flashlight 100 to programming tool 135 or programming dongle 200 may be used to provide other information from flashlight 100, such as data corresponding to programmed configurations of microprocessor 120 or other components of flashlight 100 for storage and subsequent retrieval by microprocessor 150 or PC 210.

Figure 3:
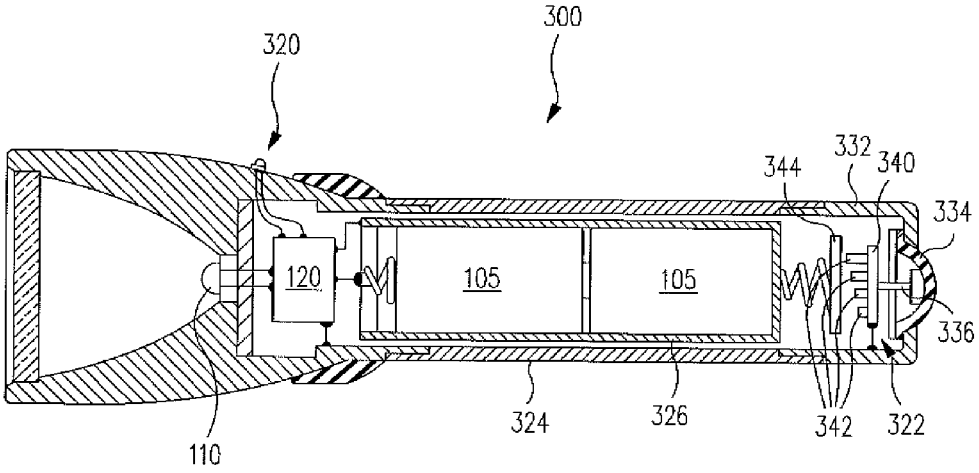
FIG. 3 is a longitudinal cross sectional view of a programmable flashlight having selectable levels of power output in accordance with an embodiment of the disclosure.

As discussed previously, the flashlight programming through LED illumination may effect a wide variety of flashlight behaviors. For example, FIG. 3 shows a flashlight 300 in which input controls 125 of FIG. 1 comprise a rear leaf spring switch 322 and a programming mode switch 320. Driver circuit 115 is not shown for illustration clarity. A normal mode of operation versus the programming mode of operation are selected by a cycling of programming mode switch 320. In other words, an initial actuation of switch 320 may select the normal mode of operation. A successive actuation of switch 320 may then select the programming mode. An additional actuation of switch 320 would then select normal mode operation, and so on. Microcontroller 120 may be configured to flash LED 110 to confirm to the user that the flashlight has entered the programming mode.

The resulting programming of microcontroller 120 controls the response of microcontroller 120 to actuation of leaf spring switch 322 during the normal mode of operation. Switch 322 is contained within a tail cap 332 having an elastomeric flexible dome 334 covering a switch actuator 336. Switch 322 has a movable portion 340 having several contacts 342 each connected to a housing ground formed by a conducting flashlight housing 324. Movable portion 340 reciprocates axially with respect to a fixed switch portion 344 connected to a conductive sleeve 326. Conductive sleeve 326 connects to a negative contact of batteries 105. A positive contact of batteries 105 couples to microcontroller 120.

Figure 4:
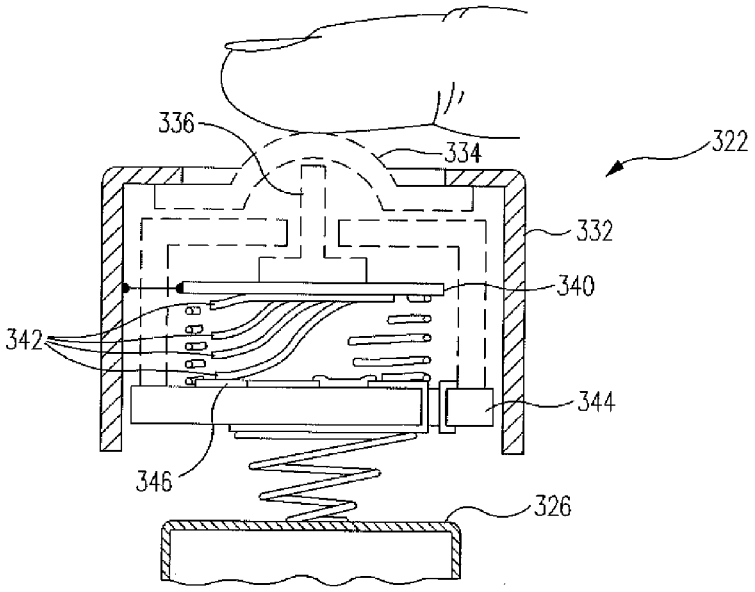
FIG. 4 is a cross-sectional view of the rear leaf spring switch for the flashlight of FIG. 3 in accordance with an embodiment of the disclosure.

As shown in FIG. 4, contacts 342 of movable portion 340 may comprise leaf springs, each extending a different distance from a base panel that is connected to the housing ground. Switch 322 of FIGS. 3 and 4 is illustrated in a simplified form for clarity of the principles of its operation. For example, switch 322 may be configured to allow a bi-level operation with contacts 342 arranged in arcs or annuluses to allow the switch to function when the tail cap 332 is rotated through a range of positions.

In one embodiment, all the leaf spring contacts 342 are connected to each other. As the switch 322 is depressed over its range of axial travel, the contacts 342 contact fixed element 344 in sequence. As discussed further in U.S. Pat. No. 7,722,209, the contents of which are hereby incorporated by reference in their entirety, fixed element 344 may include an array of pads 346 each positioned to be contacted by a respective end of a leaf spring contact 342. The pads 346 are all connected to a central node that connects via a plated through-hole or other means to the opposite side of fixed element 344, which thereby connects to conductive battery sleeve 326. Each pad 346 connects to the central node with a different intervening resistance Before the switch 322 is depressed, the resistance between fixed portion 344 and movable portion 340 is infinite. When the switch 322 is slightly depressed, a first leaf spring contact 342 makes contact with a pad 346 associated with a resistor. Microcontroller 120 may thus determine by this resistance that switch 322 has been pressed to an intermediate position. Microcontroller 120 may be programmed during the programming mode to respond to such an intermediate switch actuation with a driving of LED 110 with some desired level of power for example, the intermediate switch actuation may produce an intermediate powering of LED 110.

When elastomeric dome 334 is further depressed, another leaf spring contact 342 makes contact with a pad 346. In the simplest case, the switch 322 has only two contacts 342 (not the four illustrated), and the second contact 342 would contact a pad 346 having no resistor. This reflects a condition when the switch 322 is fully depressed, and, depending upon the applied programming, could cause microcontroller 120 to provide full brightness illumination. In the more complex embodiment illustrated, there are five switch actuation states for switch 322 (including the released condition) that may be sensed by microcontroller 120. Depending upon the applied programming, various brightness levels or preselected dimmed or hue outputs might be provided based on the actuation state.

The programming ability for microcontroller 120 provides significant additional capabilities. For example, microcontroller 120 may detect the duration of pressure on the switch 322, the magnitude of pressure, and the number and pattern of actuations (e.g., enabling distinguishing of commands in the manner of a single or multiple click computer mouse.) In one embodiment, some users will prefer programming that avoids accidental maximum illumination (e.g., such as for infantry troops operating at night), while other applications such as police work will prefer ready access to maximum illumination without delay or difficulty.

Figure 5:
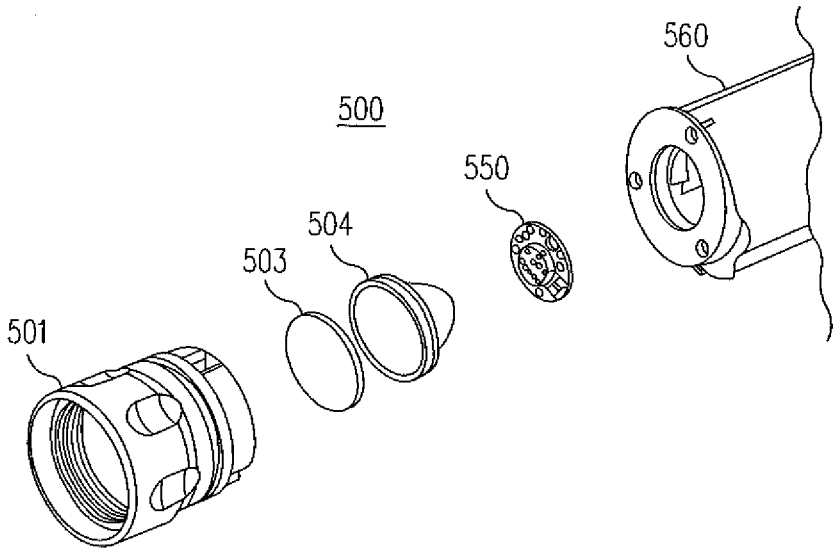
FIG. 5 is an exploded view of a programmable flashlight including selectable light sources in accordance with an embodiment of the disclosure.
Figure 6A:
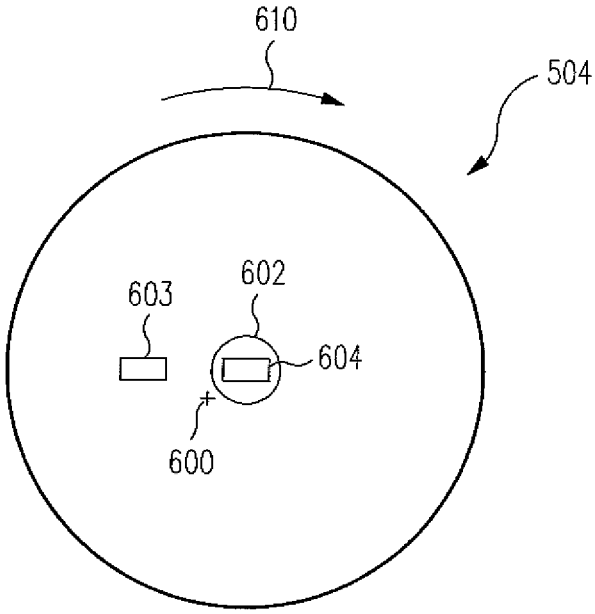
FIG. 6A shows a first selection of a light source by the flashlight of FIG. 5 in accordance with an embodiment of the disclosure.
Figure 6B:
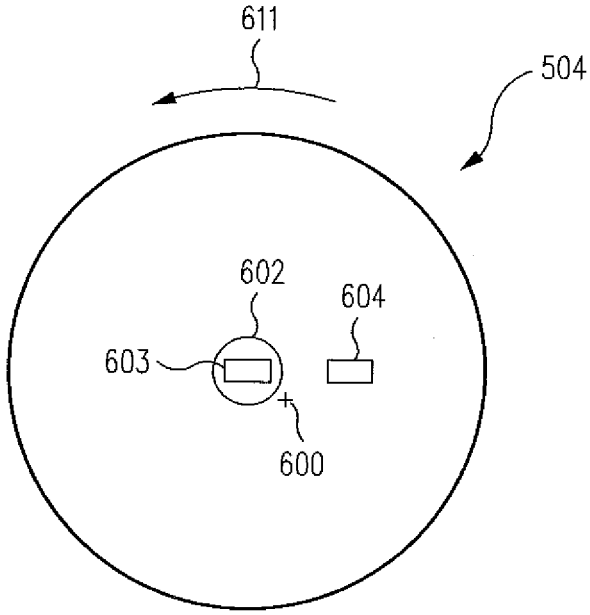
FIG. 6B shows a second selection of a light source by the flashlight of FIG. 5 in accordance with an embodiment of the disclosure.

The programmability of microcontroller 120 may be advantageously combined with an ability for a user to select from multiple light sources as described in U.S. patent application Ser. No. 12/702,146, filed Feb. 8, 2010, the contents of which are hereby incorporated by reference in their entirety. An example flashlight 500 is shown in exploded view in FIG. 5. A rotatable bezel 501 mechanically connects to a lens assembly formed from a planar lens 503 and a total internal reflection (TIR) lens 504. As seen in FIGS. 6A and 6B, TIR lens 504 is configured to have an optical source inlet 602 that is offset from a central longitudinal axis 600 for flashlight 500. Accordingly, in one embodiment, rotation of bezel 501 may result in off center rotation of bezel 501, as well as of components attached to bezel 501, such as TIR lens 504. A printed circuit board 550 includes several LEDs. For example, board 550 may include a white light LED 604 and an infrared LED 603. Depending upon the rotation of bezel 501, optical source inlet 602 will select from one of the available light sources. For example, if the bezel 501 is rotated as indicated by direction 610 of FIG. 6A, white light LED 604 is selected. Conversely, if bezel 501 is rotated as indicated by direction 611 of FIG. 6B, infrared LED source 603 is selected. A housing 560 for flashlight 500 includes the remaining components discussed with regard to flashlight 100. In one embodiment, flashlight 500 may include the rear leaf spring switch 322 and the programming mode control switch 320 discussed with regard to FIGS. 3 and 4. Microcontroller 120 may be configured to respond to a programming signal from just one of the multiple light sources. Alternatively, microcontroller may be configured to respond to a subset of the light sources or all of the light sources with respect to programming.

Bezel 501 is configured to engage stops such that it may be "clicked" through various selections of light sources as it is rotated with respect to housing 560. Microcontroller 120 may sense the selection of a light source through rotation of bezel 501 through appropriate sensors such as Hall sensors. By programming microcontroller 120 as discussed with regard to FIGS. 1 and 2, a user may program the desired brightness of selected light sources or hues. The ability of programming microcontroller 120 to record and store sequences of different durations also permits the storage of messages (e.g., such as entered by Morse code) and subsequent transmission in a regulated format that is readily receivable by other electronic devices. With the fast response time of LED lamps relative to incandescent, such messages may be "hidden" during flashlight operation (e.g., in visible or infrared wavelengths) as brief, possibly imperceptible variations of the output level.

Embodiments described above illustrate but do not limit the invention. Thus, it should also be understood that numerous modifications and variations are possible in accordance with the principles of the present invention. Accordingly, the scope of the invention is defined only by the following claims.

What is claimed is:

1. A flashlight, comprising:

a light emitting diode (LED);

a controller configured to, in a programming mode of operation, receive a programming signal generated by the LED in response to illumination of the LED with an externally-supplied light signal modulated with the programming signal; and a first switch, wherein the controller is configured to transition between the programming mode of operation and a normal mode of operation with respect to an actuation of the first switch.

2. The flashlight of claim 1, wherein the programming signal is an on-off programming signal.

3. The flashlight of claim 1, wherein the controller is configured to drive an illumination of the LED to confirm receipt of the programming signal to an external programming tool.

4. The flashlight of claim 3, wherein the external programming tool includes a controller for generating the programming signal.

5. The flashlight of claim 3, wherein the external programming tool couples to a computer, and wherein the computer generates the programming signal.

6. The flashlight of claim 5, wherein the external programming tool couples to the computer through a universal serial bus (USB) cable.

7. The flashlight of claim 1, further comprising a second switch including a plurality of leaf spring contacts, wherein the controller is programmable according to the programming signal to respond to actuation of the leaf spring contacts by varying a power level for the LED.

8. The flashlight of claim 1, wherein the LED comprises a plurality of LEDs.

9. The flashlight of claim 8, wherein the plurality of LEDs includes a white-light LED and an infrared LED.

10. The flashlight of claim 9, further comprising:

a rotatable total internal reflection (TIR) lens, wherein a first rotation of the TIR lens selects the white-light LED and a second rotation of the TIR lens selects the infrared LED; and a rotatable bezel mechanically coupled to the TIR lens, wherein a user rotates the TIR lens through rotation of the rotatable bezel.

11. The flashlight of claim 1, wherein the controller comprises a microcontroller or a microprocessor.

12. The flashlight of claim 1, further comprising one or more input controls configured to receive user actuations;

wherein the LED is configured to emit light in the normal mode of operation; and wherein the controller is configured to be programmed by the programming signal to select among a plurality of operations of the LED in response to the user actuations received at the input controls.

13. A method, comprising:

actuating a switch on a flashlight to select for a programming mode;

with the flashlight in the programming mode, illuminating a light emitting diode (LED) in the flashlight with a light signal modulated with a programming signal, wherein the LED generates a current responsive to the illumination; and programming a controller within the flashlight according to the programming signal received from the illuminated LED.

14. The method of claim 13, further comprising:

in response to illumination of the flashlight's LED with the modulated light signal, powering the LED to transmit a modulated light signal back to an external programming tool to indicate a successful programming of the controller.

15. The method of claim 13, further comprising in response to illumination of the flashlight's LED with the modulated light signal, powering the LED to transmit a modulated light signal back to an external programming tool to indicate an unsuccessful programming of the controller.

16. The method of claim 13, wherein programming the controller comprises programming the controller to vary a power level for the LED in response to an actuation of the switch.

17. The method of claim 13, wherein:

the LED is configured to emit light in a normal mode of operation; and the method further comprises programming the controller by the programming signal to select among a plurality of operations of the LED in response to actuations at one or more input controls of the flashlight.

18. A system comprising:

a lighting device programming tool, comprising:

a housing adapted to mate with a flashlight bezel;

a light emitting diode (LED) contained within the housing; and a driving circuit operable to drive the LED according to a programming signal supplied by a programming host and decode a programming confirmation signal received through illumination of the LED.

19. The system of claim 18, further comprising a universal serial bus (USB) port to receive the programming signal.

20. The system of claim 18, wherein the LED is a first LED, the system further comprising:

a lighting device, comprising:

one or more input controls configured to receive user actuations;

a second LED configured to emit light in a normal mode of operation and receive a light signal from the first LED in a programming mode of operation; and a controller configured to, in the programming mode of operation, receive the programming signal generated by the second LED in response to illumination of the second LED by the light signal from the first LED, wherein the light signal is modulated with the programming signal by which the controller is programmed to select among a plurality of operations of the second LED in response to the user actuations received at the input controls.

* * * * *